US011465717B1

(12) United States Patent
Way

(10) Patent No.: US 11,465,717 B1
(45) Date of Patent: Oct. 11, 2022

(54) FLOATING LIFT SYSTEM FOR FLOATING OR FIXED DOCKS AND METHOD OF USE

(71) Applicant: Robert Lindsay Way, Brunswick, GA (US)

(72) Inventor: Robert Lindsay Way, Brunswick, GA (US)

( * ) Notice: Subject to any disclaimer, the term of this patent is extended or adjusted under 35 U.S.C. 154(b) by 59 days.

(21) Appl. No.: 17/108,899

(22) Filed: Dec. 1, 2020

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS 4,226,202 A * 10/1980 Conrad ..... B63B 27/36 114/263
6,032,601 A * 3/2000 Gates ..... B63C 1/02 114/45
7,603,959 B1 * 10/2009 Veazey ..... E02B 3/062 114/263
9,517,820 B2 * 12/2016 Fuhrmann ..... B63C 1/02
10,131,410 B2 * 11/2018 Blume ..... B63C 3/06
10,745,092 B2 * 8/2020 Lydle ..... B63C 1/00
2017/0190398 A1 * 7/2017 Barnes ..... B63C 1/06
2019/0210700 A1 * 7/2019 Cibilich ..... B63C 3/02

FOREIGN PATENT DOCUMENTS

WO WO-2004022421 A1 * 3/2004 ..... B63B 23/32

* cited by examiner

*Primary Examiner* — S. Joseph Morano
*Assistant Examiner* — Jovon E Hayes
(74) *Attorney, Agent, or Firm* — Leavitt Eldredge Law Firm

(57) ABSTRACT

A floating lift system capable of fully integrating into an existing floating or fixed dock or into a floating or fixed dock currently in construction that allows users to employ a plurality of utilitarian uses, thereby providing for enhanced user experience. The floating lift system includes an elevator deck comprising of a parent floating dock adapter and a lift deck extender; a lift deck; and an air control system. The floating lift system allows for the raising and lowering of load into and out of water.

5 Claims, 11 Drawing Sheets

FLOATING LIFT SYSTEM FOR FLOATING OR FIXED DOCKS AND METHOD OF USE

BACKGROUND

1. Field of the Invention

The present invention relates generally to floating watercraft lift systems, and more specifically to a floating lift system that utilizes an elevator deck extension for raising and lowering load into and out of water, wherein the elevator deck extension is coupled complementarily to a parent floating or fixed dock, thereby providing an aesthetically pleasing appearance for the parent floating or fixed dock.

2. Description of Related Art

Floating watercraft lift systems are well known in the art and are effective means for raising vessels out of the water for maintenance, repair, or storage. Conventional floating watercraft lift systems utilize one of two methods to raise and lower vessels by employing a series of ballast floats that delivers and discharges air therefrom. In the first method, ballast floats only partially submerge in water during vessel launching or retrieval. Ballast floats are typically tied down via rope to a cleat on a floating or fixed dock to prevent the vessel and the ballast from floating away. In the second method, ballast floats completely submerge into water during vessel launching. Unlike in the first method, the second method requires the ballast floats to be mechanically connected to a fixed mass such as a fixed or floating dock.

One of the problems associated with current floating watercraft lift systems is their overall arrangement. Current floating watercraft lift systems do not provide an avenue to fully integrate into a floating or fixed dock and thus interrupts the overall aesthetic appearance of the floating or fixed dock. Moreover, current floating watercraft lift systems are limited to raising only vessels, thereby requiring users to employ other means for raising and lowering load into and out of water.

Hence, it would be advantageous to have a system that fully integrates into a parent floating or fixed dock, thereby providing an aesthetically pleasing appearance for the parent floating or fixed dock. In addition, it would be advantageous to have a system that raises and lowers any type of load into and out of water and offers additional usable deck surface area, thereby providing utilitarian uses.

Accordingly, although great strides have been made in the area of floating watercraft lift systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
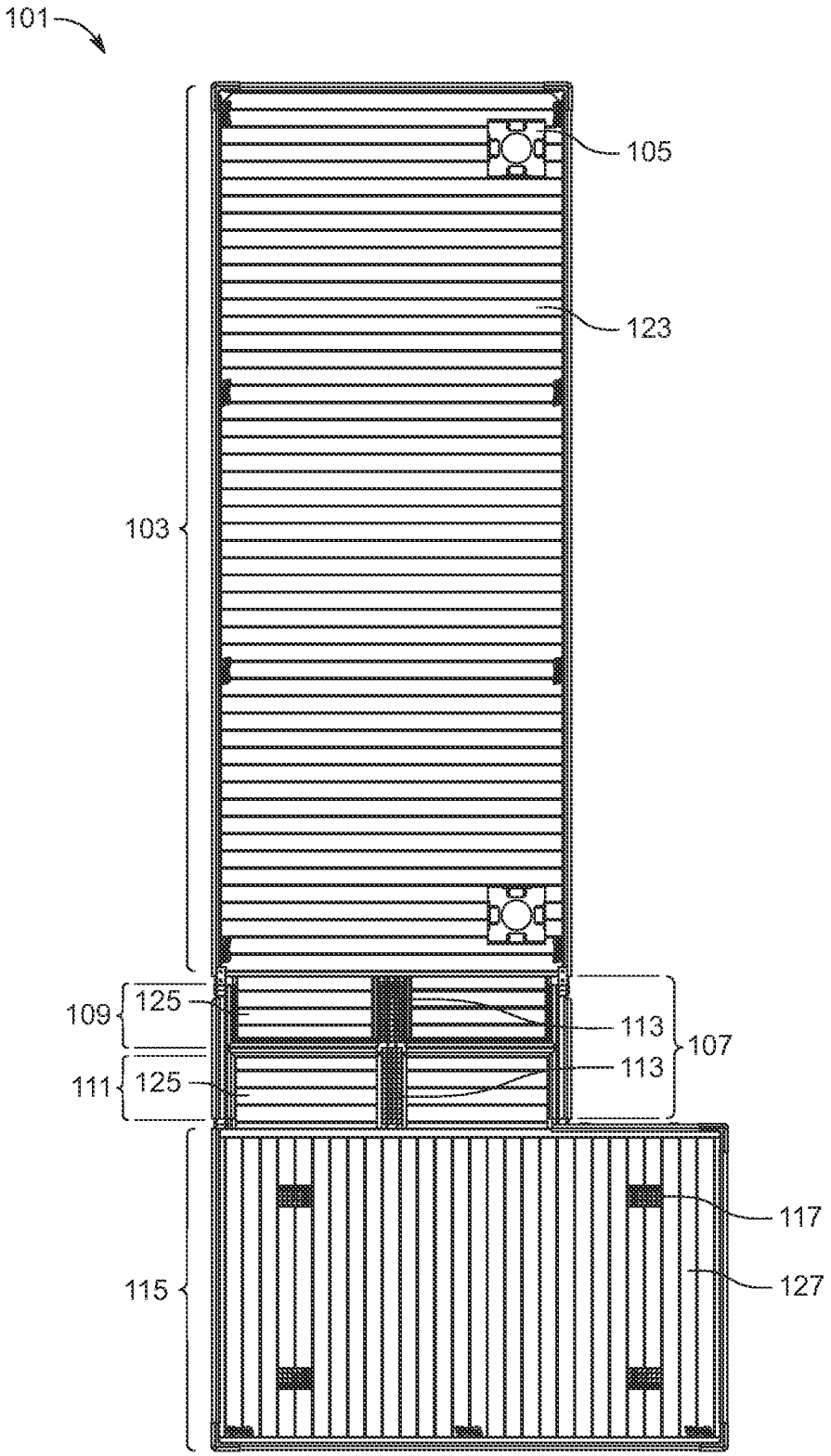
FIG. 1A is a top view of a floating lift system fully raised in accordance with one or more embodiments of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional floating dock lift systems. Specifically, the present invention provides a system that can fully integrate into an existing floating or fixed dock, creating a harmonious union, thereby providing for improved aesthetic appearance. In addition, the system of the present invention allows the user to employ a plurality of utilitarian uses, thereby providing for enhanced user experience. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1A-1D depict various views of a floating lift system in accordance with one or more embodiments of the present application. It will be appreciated that floating lift system 101 overcomes one or more of the above-listed problems commonly associated with conventional floating watercraft lift systems. It should also be appreciated that the floating lift system 101 may vary based on aesthetical, functional, or manufacturing considerations.

Figure 8:
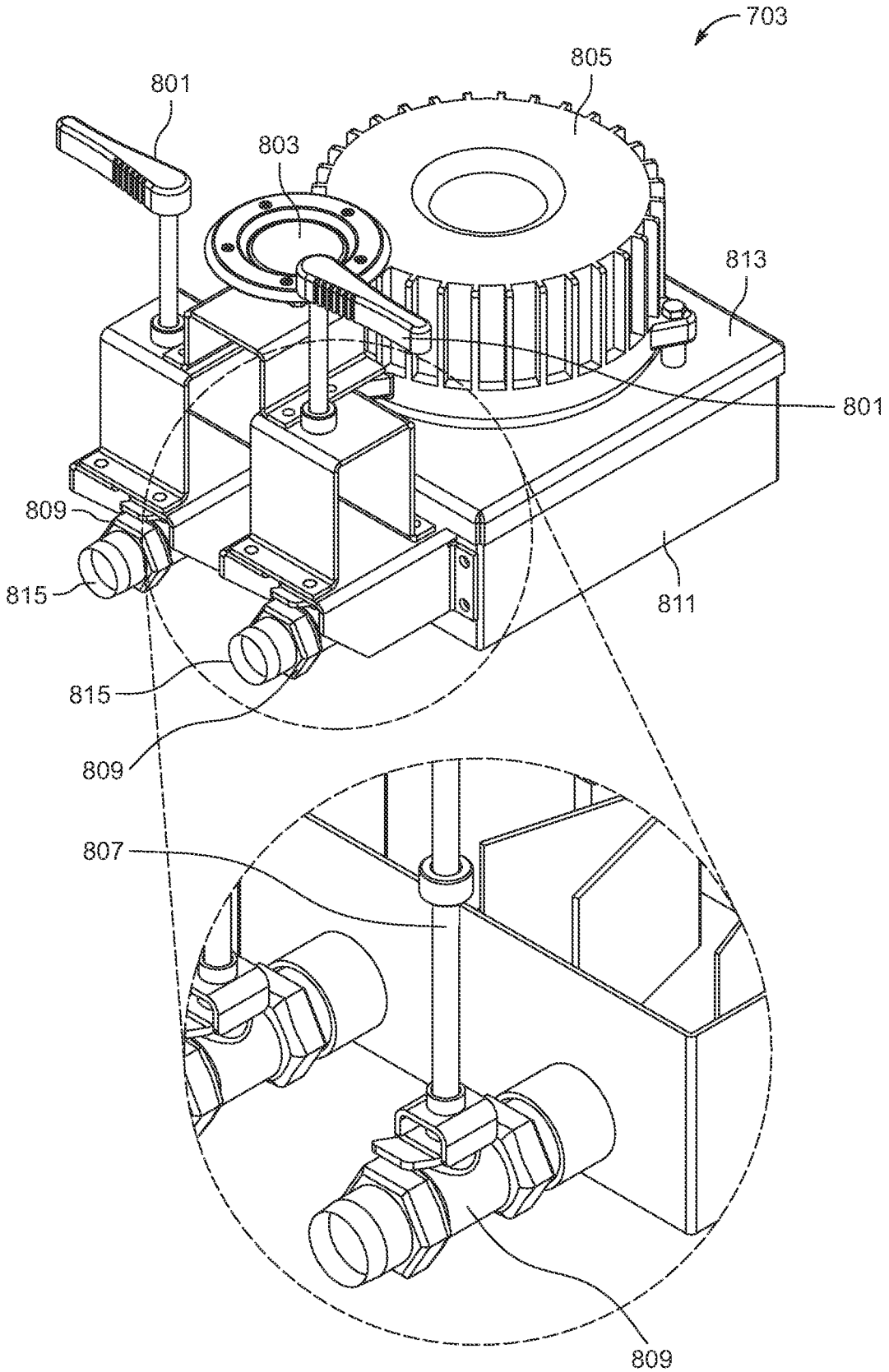
FIG. 8 is a perspective view of the air box valve and blower of the air control system of FIG. 7 in accordance with one or more embodiments of the present application.

In the contemplated embodiment, floating lift system 101 includes an elevator deck 107, a lift deck 115, and an air control system (not shown, see FIG. 8 for further discussion). The elevator deck 107 comprises of a parent dock adapter 109, a lift deck adapter 111, one or more grating covers 113, and a walking surface area 125. The parent dock adapter 109 is configured to securely attach the elevator deck 107 to a parent dock 103. The one or more grating covers 113 are configured to conceal the link arms (not shown, see FIG. 3 for further discussion) connecting the parent dock adapter 109 and the lift deck adapter 111. The lift deck adapter 111 is configured to securely attach the lift deck 115 to the parent dock adapter 109 via two or more link arm sets (not shown, see FIG. 3 for further discussion).

It should be appreciated that the parent dock 103 can be any existing floating or fixed dock or any floating or fixed dock currently in construction. It should also be appreciated that the parent dock 103 can include one or more pilings 105, one or more floatation air chambers 121, and a walking surface area 123.

Figure 1B:
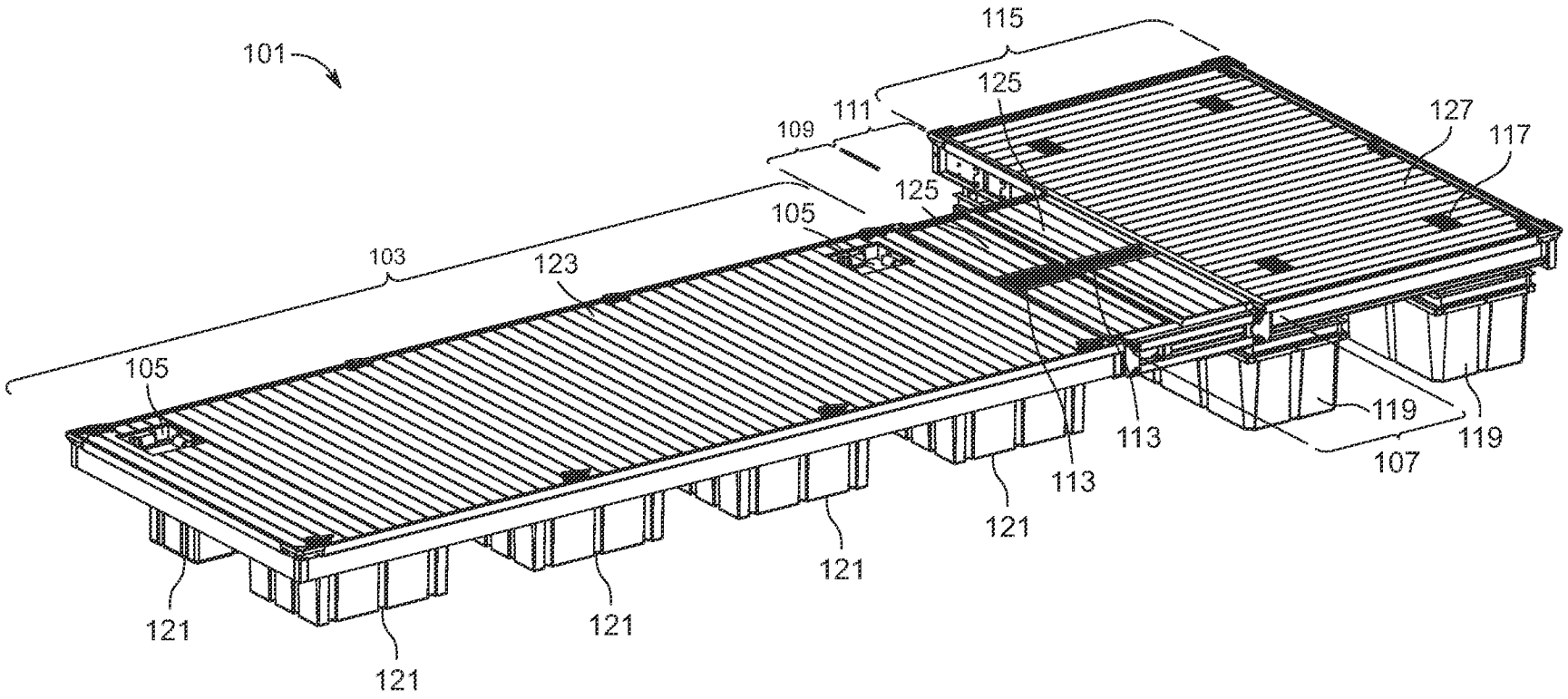
FIG. 1B is a rear perspective view of a floating lift system fully raised in accordance with one or more embodiments of the present invention.
Figure 1C:
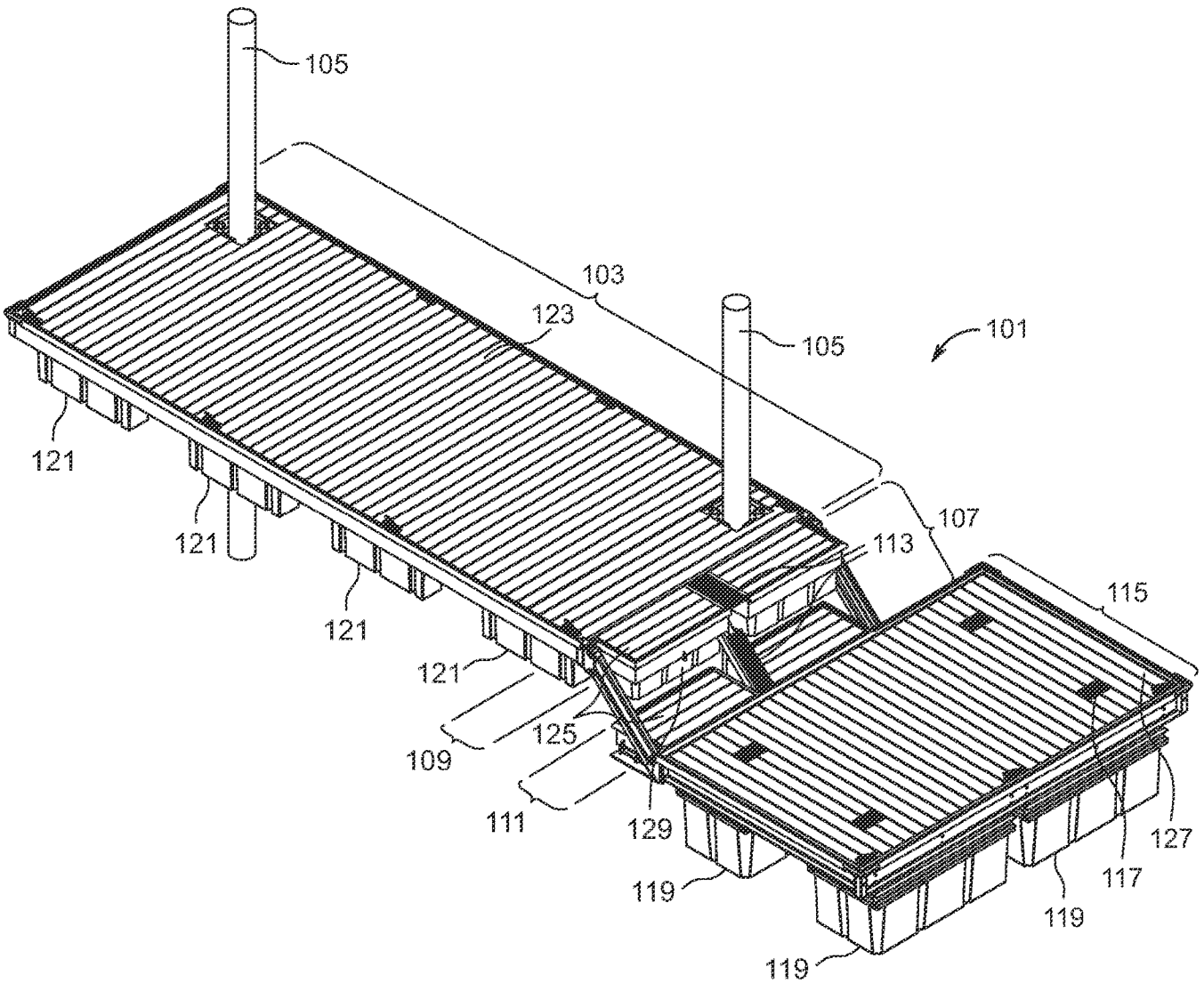
FIG. 1C is a left perspective view of a floating lift system fully lowered in accordance with one or more embodiments of the present invention.

In some embodiments, the lift deck 115 comprises of one or more vessel support bunks 411 (not shown, see FIG. 4 for further detail), one or more floatation air chambers 119, and a walking surface area 127, as shown in FIGS. 1A-1C. The one or more floatation air chambers 119 couple directly beneath the elevator deck 107.

It should be appreciated that the one or more vessel support bunks 411 (not shown, see FIG. 4 for further detail) can be removable and the deck opening can be concealed with one or more coverings 117 to further enhance the overall aesthetic appearance. It should also be appreciated that although the elevator deck 107 is shown at the end of the parent floating dock 109, it is contemplated that the attachment of the elevator deck 107 to the parent floating dock 103 can vary in location, size, style, and the like.

In some embodiments, the parent dock adapter 109 may include one or more parent dock adapter support floats 129 coupled thereunder configured to offset the weight of the dead weight of the parent dock adapter 109 as the one or more floatation air chambers 119 merge into water.

Figure 1D:
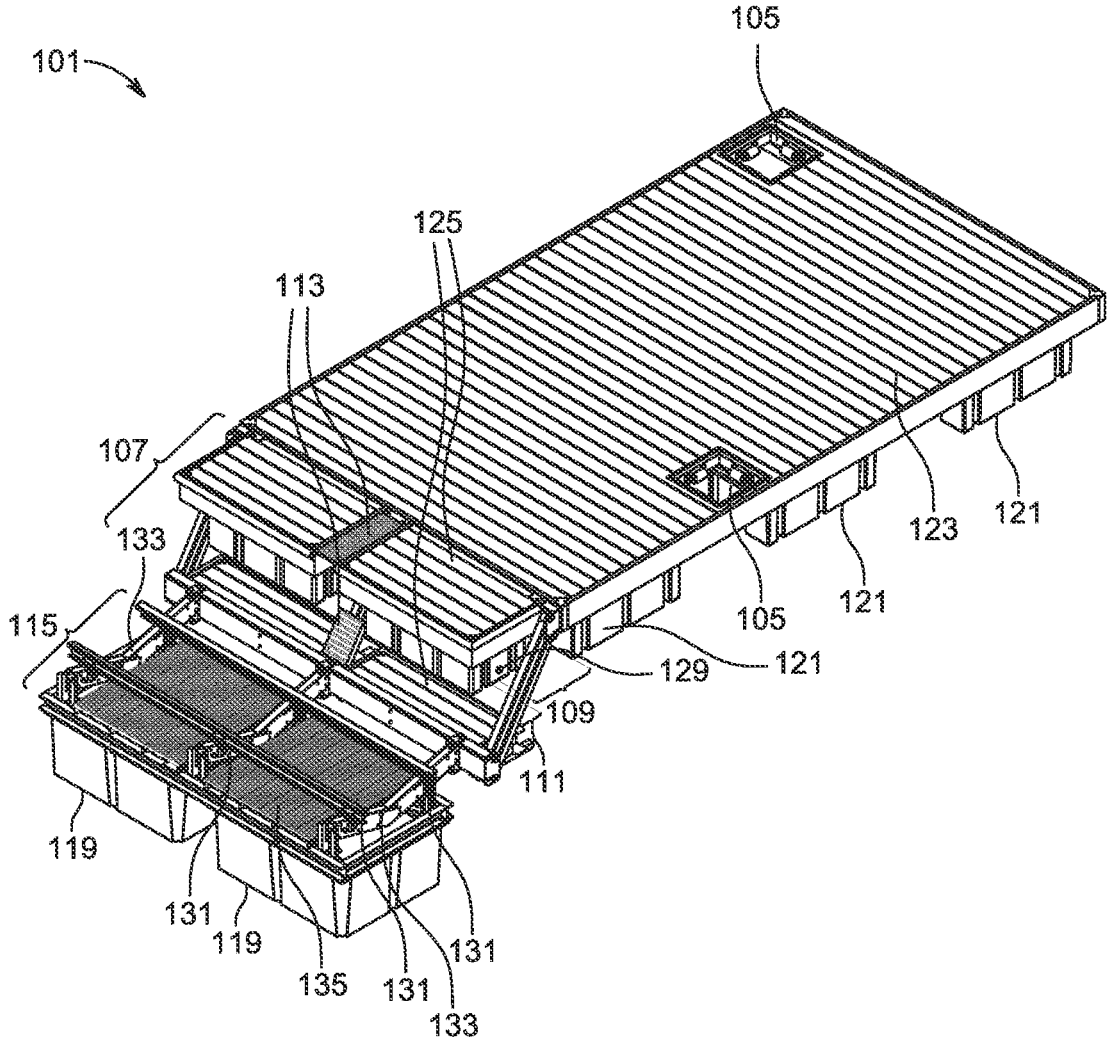
FIG. 1D is a right perspective view of a floating lift system fully lowered in accordance with one or more embodiments of the present invention.

In other embodiments, the lift deck 115 includes a v-hull bunking adapter 131 in lieu of a flat walk deck, as shown in FIG. 1D. The v-hull bunking adapter 131 includes one or more support arms 133 configured to support a v-hull vessel. The lift deck 115 also includes a grate walk deck 133 configured to allow a user to walk across the v-hull bunking adapter 131 safely.

In some embodiments, a user may utilize the walking surface areas 125, 127 as an extension of the walking surface area 123 of the parent dock 103 while the system is in the fully raised position. In one embodiment, the user may use the lift deck 115 to readily descend into and/or ascend from water during various activities including, without limitation, swimming, diving, aquatic physical therapy, and the like. In another embodiment, the user may use the lift deck 115 to readily raise and lower vessels into water including, without limitation, motorboats, canoes, kayaks, speedboats, rowboats, or the like.

It should also be appreciated that one of the unique features believed characteristic of the present application is the configuration of the elevator deck and the lift deck that allows for uniform integration to a parent dock. In addition, the installation of the air control system does not disrupt the aesthetic appearance of the parent dock, thereby providing for an overall uniform façade.

Figure 2:
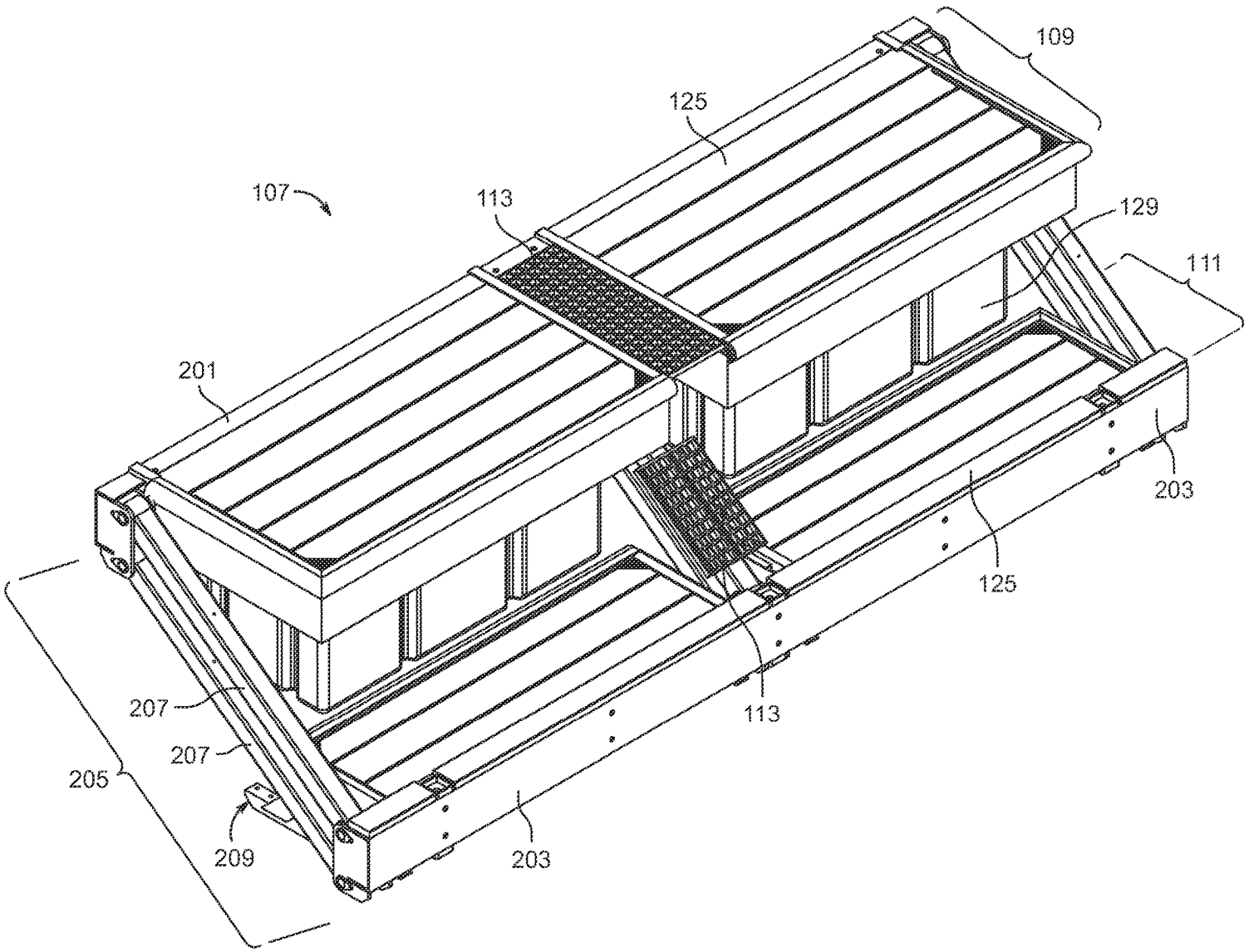
FIG. 2 is a perspective view of the elevator deck of FIGS. 1A-1D in accordance with one or more embodiments of the present application.

In FIG. 2, a perspective view of the elevator deck 107 is shown. The elevator deck 107 includes a parent dock adapter mount 201, a lift deck spar beam 203, one or more sets 205 of link arms 207, one or more parent dock adapter support floats 129, and one or more lift deck adapter up stops 209. The parent dock adapter mount 201 is configured to couple the parent dock adapter 109 to any location of the parent dock 103. The one or more lift deck adapter up stops 209 are configured to prevent the lift deck adapter 111 and the lift deck 115 from being raised to an elevation higher than the parent dock 103.

Figure 3:
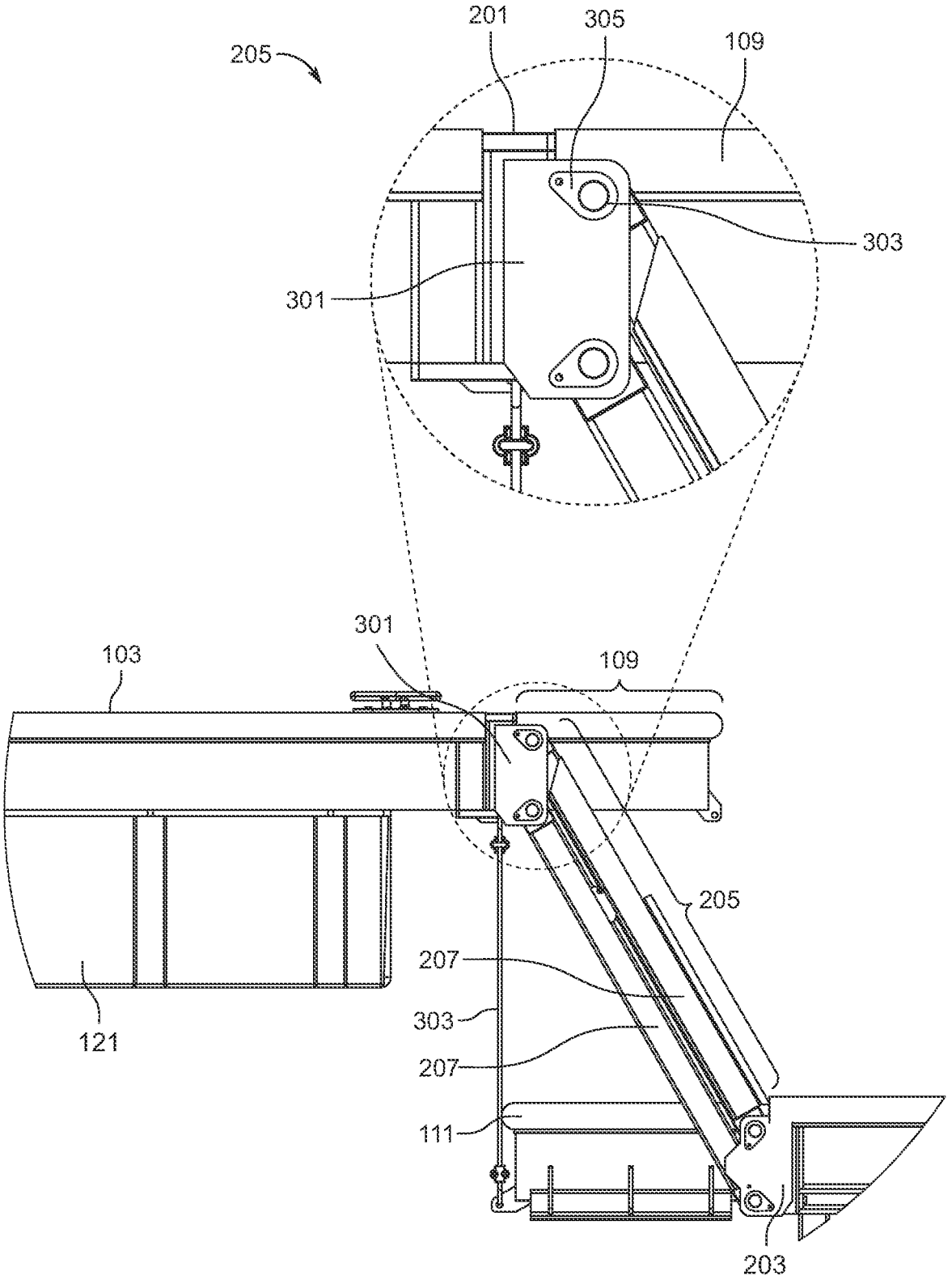
FIG. 3 is a profile view of a set of link arms of the elevator deck of FIGS. 1A-1D in a lowered position in accordance with one or more embodiments of the present application.

In FIG. 3, profile view of a set 205 of link arms 207 of the elevator deck 107 of FIGS. 1A-1D in a lowered position is shown. Each end of the set 205 of link arms 207 includes one or more link arm side plates 301, one or more pivot pins 303, and one or more pin captive fasteners 305. The link arm side plates 301, pivot pins 303, and pin captive fasteners 305 are configured to connect the first end of the set 205 of link arms 207 to the parent dock adapter mount 201 and connect the second end of the set 205 of link arms 207 to the lift deck spar beam 203. The floating dock lift system 101 also includes one or more down limit cables 307 configured to connect the parent dock adapter 109 and the lift deck adapter 111.

Figure 4:
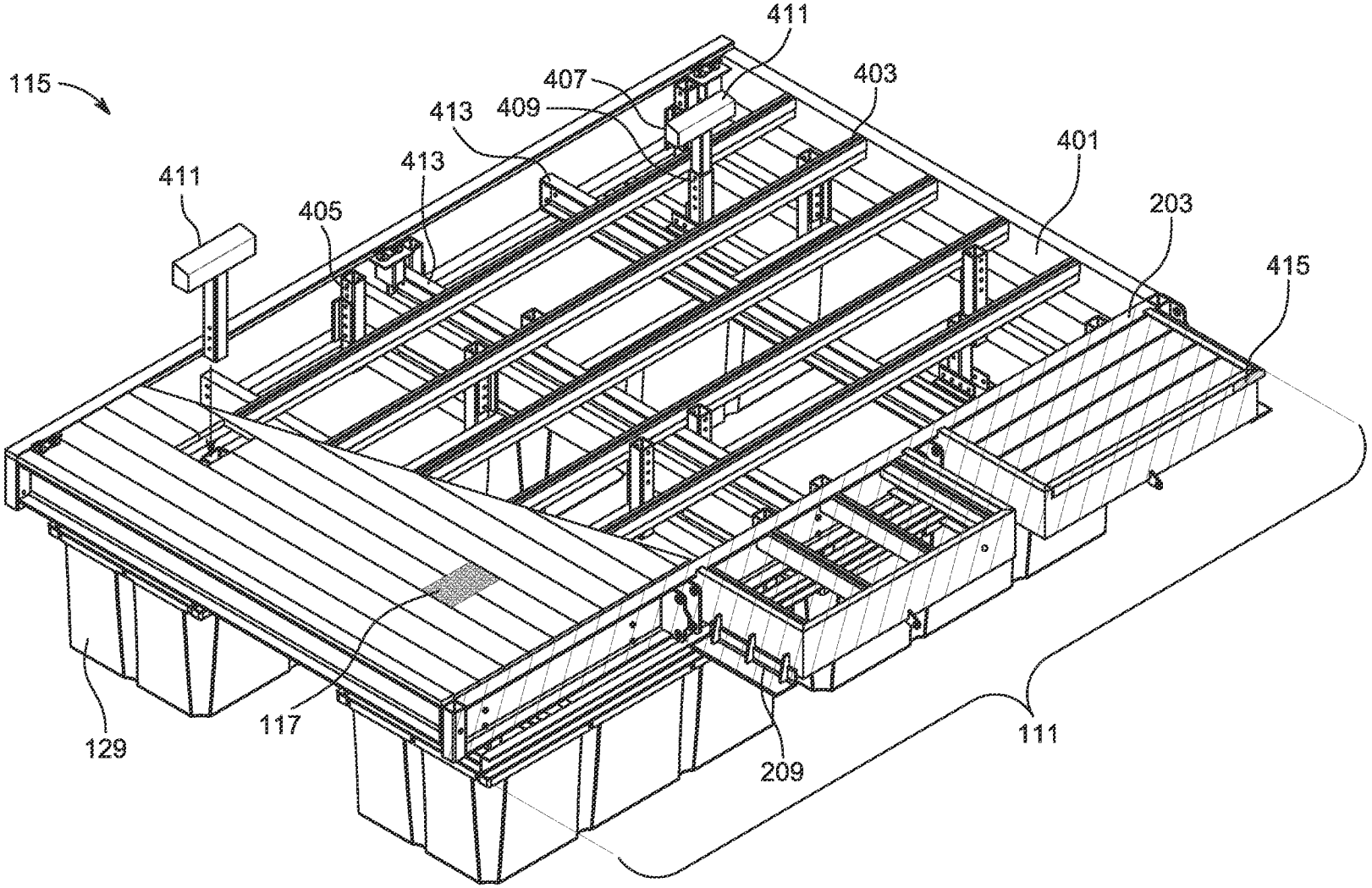
FIG. 4 is a perspective view of the lift float of FIGS. 1A-1C with the walking surface area partially removed in accordance with one or more embodiments of the present application

In FIG. 4, a perspective view of the lift deck 115 of FIGS. 1A, 1B and 1C with the walking surface area 127 partially removed is shown. As stated above, the lift deck 115 includes one or more vessel support bunks 411. It should be appreciated that the one or more vessel support bunks 411 can comprise of any material suitable to prevent the hull of a vessel from being damaged including, without limitation, carpet, wood, plastic, and metal.

The lift deck 115 also includes a frame 401 with integrated lift deck spar beam 203, one or more aluminum deck joists 403, one or more deck frame piers 405, one or more deck frame pier brackets 407, and one or more bunk post receivers 409. The one or more bunk post receivers 409 are configured to receive the one or more vessel support bunks 411, as depicted with directional arrows. The lift deck 115 further includes one or more deck cross-members 413, and one or more vinyl rub rails 415.

Figure 5A:
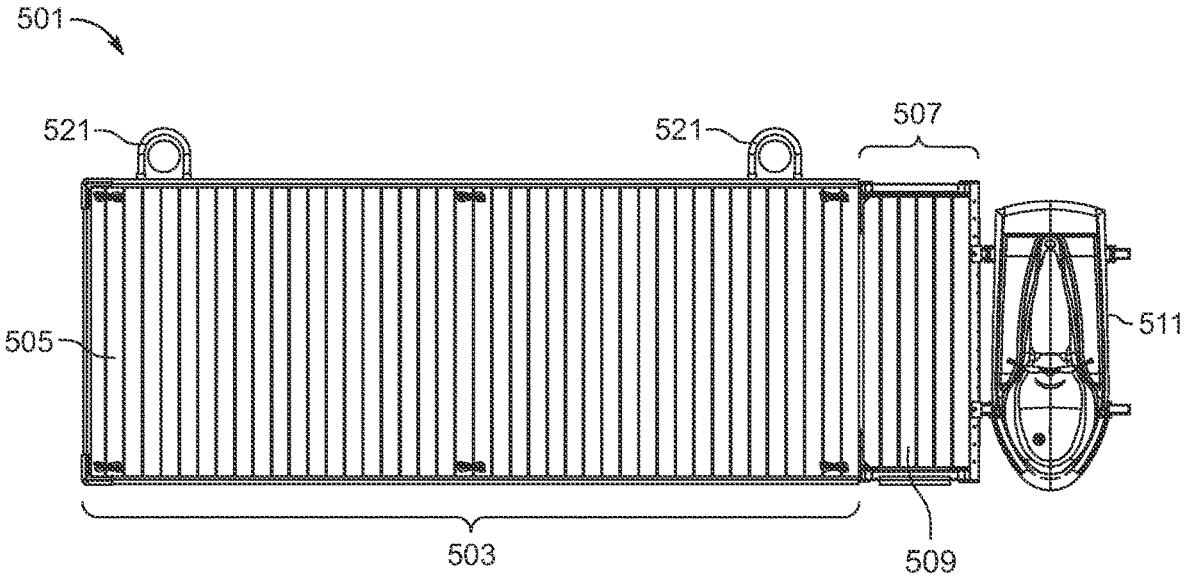
FIG. 5A is a top view of an alternative floating lift system fully raised with a watercraft in accordance with one or more embodiments of the present invention.
Figure 5B:
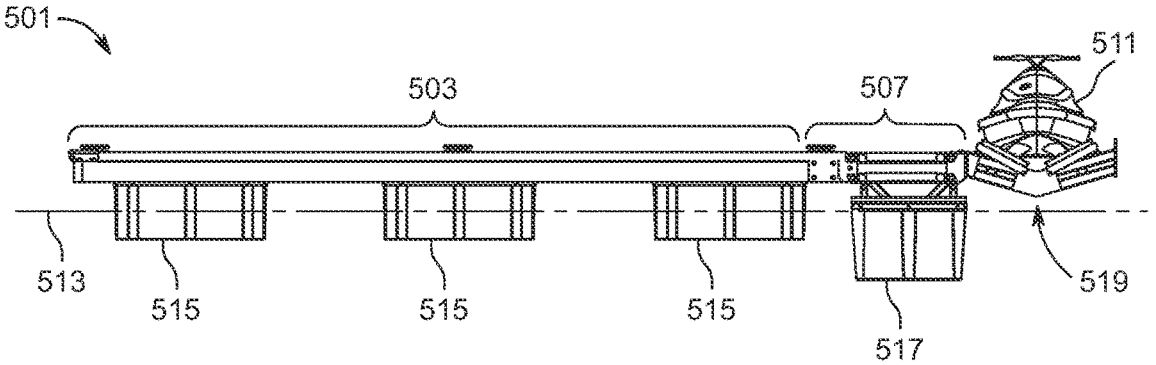
FIG. 5B is a profile view of an alternative floating lift system fully raised with a watercraft in accordance with one or more embodiments of the present invention.
Figure 5C:
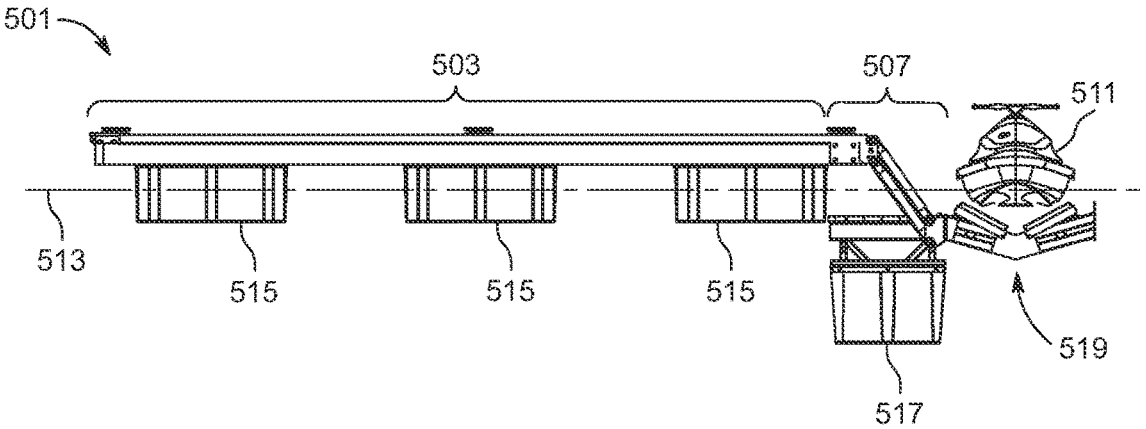
FIG. 5C is a profile view of an alternative floating lift system fully lowered with a watercraft in accordance with one or more embodiments of the present invention.

Referring now to FIGS. 5A, 5B and 5C, various views of an alternative floating lift system 501 are depicted. The floating lift system 501 includes an elevator deck 507 and an air control system (not shown, see FIG. 7 for further discussion). The elevator deck 507 comprises of a walking surface area 509 and one or more floatation air chambers 517. The elevator deck 507 is configured to securely attach to a parent dock 503. The one or more floatation air chambers 517 couple directly underneath the elevator deck 507.

It should be appreciated that the parent dock 503 can be any existing floating or fixed dock or any floating or fixed dock currently in construction. In addition, it should be appreciated that the parent dock 503 can include one or more floatation air chambers 515, one or more pilings 521, and a walking surface area 505. It should also be appreciated that although the elevator deck 507 is shown at the end of the parent floating dock 503, it is contemplated that the attachment of the elevator deck 507 to the parent dock 503 can vary in location, size, style, and the like.

As shown, the elevator deck 507 also includes one or more sets of cradle arms 519 configured to support a vessel 511 including, without limitation, a motorboat, a canoe, a kayak, a speedboat, a rowboat, or the like. In the contemplated embodiment, the elevator deck 507 is configured to raise the vessel 511 above the water line 513 and to lower the vessel 511 below the water line 513.

Figure 6:
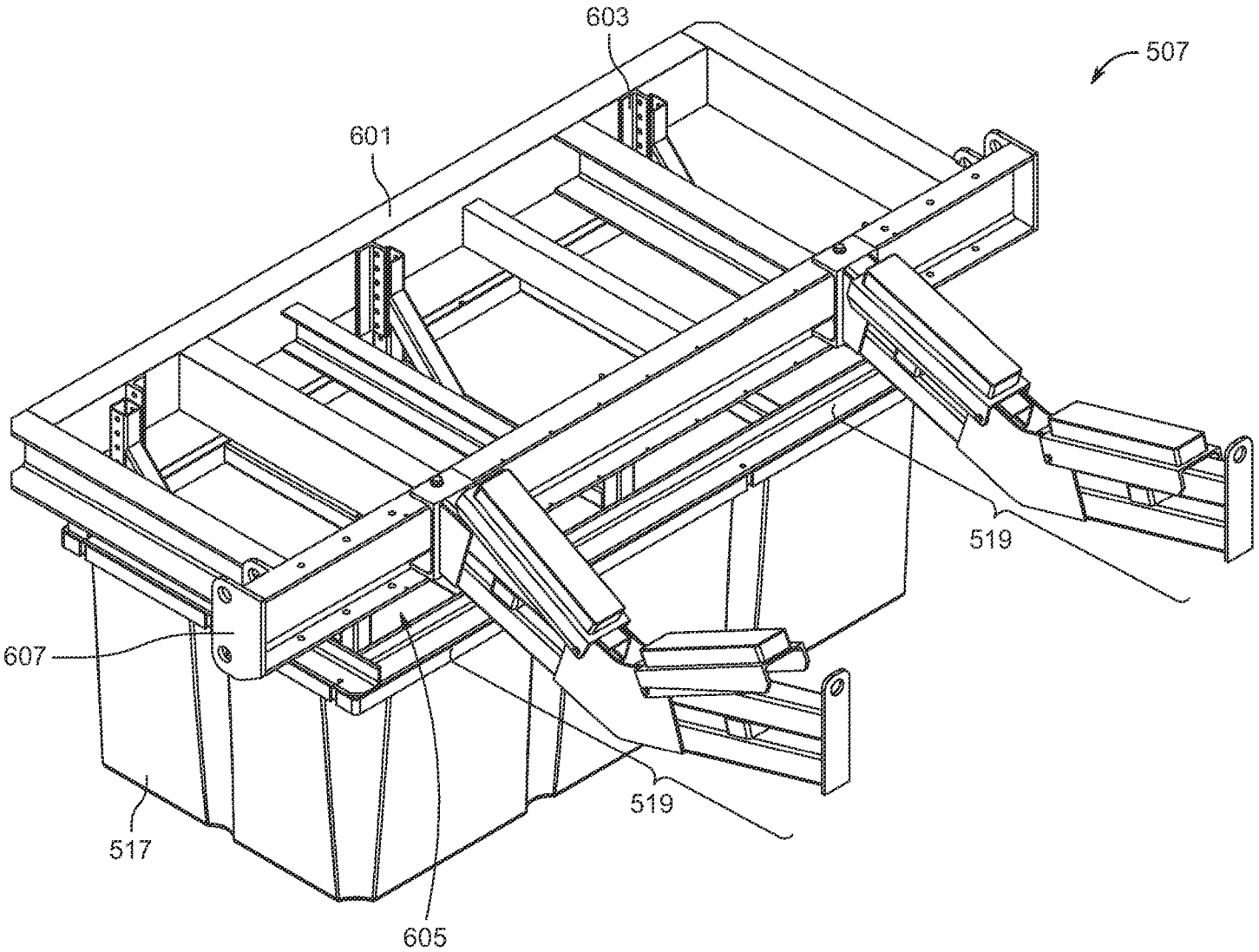
FIG. 6 is a perspective view of the elevator deck of FIGS. 5A-5C with the walking surface area removed in accordance with one or more embodiments of the present application.

In FIG. 6, a perspective view of the elevator deck 507 of FIGS. 5A, 5B and 5C with the walking surface area 509 removed is shown. As depicted, the elevator deck 507 further includes a frame 601, one or more deck frame pier brackets 603, one or more riser beams 605, and one or more pivot pins 607.

Figure 7:
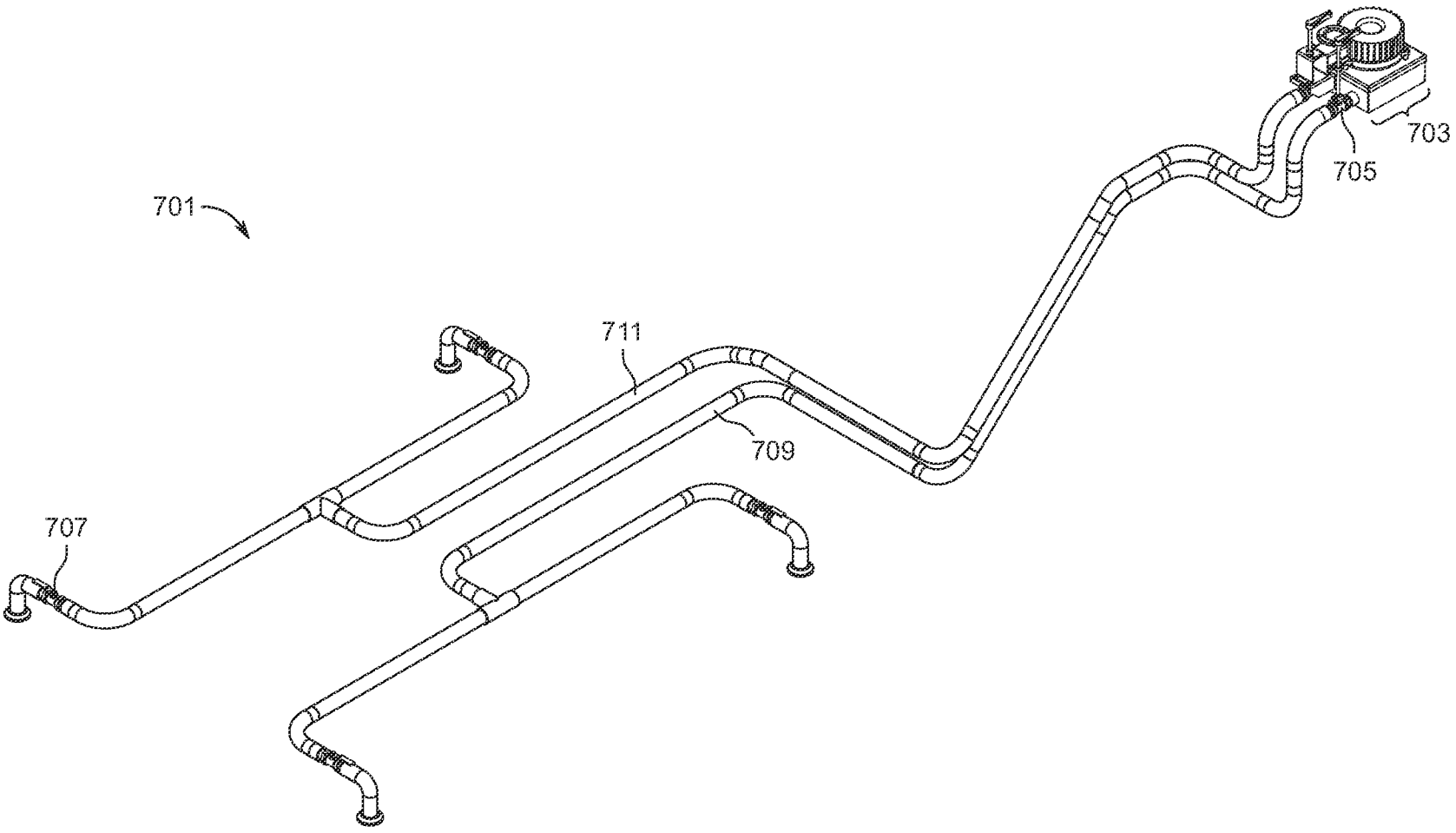
FIG. 7 is a schematic of an air control system in accordance with one or more embodiments of the present invention.

In FIG. 7, a schematic of an air control system 701 is depicted. The air control system 701 is configured to manage the pressurized air within the one or more floatation air chambers 119, 515. The air control system 701 includes an air box valve and centrifugal blower 703, one or more air box control ball valves 705, one or more isolation ball valves 707, a forward air hose circuit 709, and a rear air hose circuit 711. It should be appreciated that the installation of air control system 701 within lift systems 101, 501 allows for an overall uniform façade of parent decks 103, 503.

In FIG. 8, a perspective view of the air box valve and centrifugal blower 703 of the air control system 701 is depicted. The air box valve and centrifugal blower 703 includes one or more manual air valve operators 801, an operator blower-foot switch 803, an air blower 805, a valve actuator rod-air valve 807, one or more ball valves 809, an air box plenum 811, a plenum cover-blower base 813, and one or more bar hose fittings 815. It should be appreciated that the one or more manual air valve operators 801 can employ electric solenoids to electrically operate the air valve operators.

During use, when the user engages the one or more manual air valve operators 801 to lower the lift deck 115, air trapped within the one or more floatation air chambers 119, 515 escape to the atmosphere, causing the lift deck 515 to descend. The lift deck 115 continues to descend until either the one or more air valve operators 801 are closed, the lift deck 115 reaches the end of mechanical travel, or the slack in the one or more down limit cables 307 is taken up.

Additionally, during use, when the user engages the one or more manual air valve operators 801 to raise the lift deck 115, the operator blower-foot switch 803 is depressed. As the operator blower-foot switch 803 is acted upon, air is pumped into the one or more floatation chambers 119, 515 via the air blower 805, forcing water within the one or more floatation chambers 119, 515 to discharge.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A floating lift system for parent docks, comprising:
- an elevator deck configured to move load into and out of water along a vertical axis;
- a lift deck configured to support load being moved into and out of water along a vertical axis;
- one or more swingarms, the one or more swingarms having:
  - a first end; and
  - a second end; and
  - wherein the first end is coupled to the elevator deck; and
  - wherein the second end is coupled to the lift deck; and
- an air control system configured to manage the displacement of pressurized air within one or more floatation chambers;
- wherein the elevator deck is coupled to a parent dock;
- wherein the elevator deck is level with the parent dock; and
- wherein the one or more floatation chambers are coupled to the lift deck thereunder.

2. The system of claim 1, wherein the elevator deck further comprises:
- a parent dock adapter configured to couple the elevator deck to the parent dock;
- a lift deck adapter configured to couple the elevator deck to the lift deck; and
- a walking surface area.

3. The system of claim 1, wherein the elevator deck includes one or more sets of cradle arms configured to support a vessel.

4. The system of claim 1, wherein the air control system further comprises:
- an air box valve and blower;
- one or more air box control ball valves;
- one or more isolation ball valves;
- a forward air hose circuit; and
- a rear air hose circuit.

5. The system of claim 4, wherein the air box valve and blower further comprises:
- one or more manual air valve operators;
- one or more operator blower-foot switch;

at least one air blower;
at least one valve actuator rod-air valve;
one or more ball valves;
an air box plenum;
a plenum cover-blower base; and
one or more hose fittings.

* * * * *